US011211760B2

(12) United States Patent
Jennings et al.

(10) Patent No.: US 11,211,760 B2
(45) Date of Patent: Dec. 28, 2021

(54) STUTTER STEP PRESS-FIT CONNECTOR INSERTION PROCESS

(71) Applicant: International Business Machines Corporation, Armonk, NY (US)

(72) Inventors: Timothy Jennings, Rochester, MN (US); Theron Lee Lewis, Rochester, MN (US); Timothy Younger, Rochester, MN (US); David Braun, St. Charles, MN (US); John R. Dangler, Rochester, MN (US); Jennifer I. Bennett, Rochester, MN (US); Stephen Hugo, Stewartville, MN (US); James Bielick, Pine Island, MN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 225 days.

(21) Appl. No.: 16/565,895

(22) Filed: Sep. 10, 2019

(65) Prior Publication Data

US 2021/0075179 A1 Mar. 11, 2021

(51) Int. Cl.
*H01R 43/20* (2006.01)
*H01R 12/58* (2011.01)

(52) U.S. Cl.
CPC ..... *H01R 43/205* (2013.01); *H01R 12/585* (2013.01)

(58) Field of Classification Search
CPC . H01R 43/205; H01R 12/585; Y10T 29/4913; Y10T 29/4914; Y10T 29/49147; Y10T 29/5327
(Continued)

(56) References Cited

U.S. PATENT DOCUMENTS 5,509,192 A * 4/1996 Ota ..... H01R 43/205 29/703
6,036,524 A 3/2000 Suzuki et al.
(Continued)

FOREIGN PATENT DOCUMENTS

CN 202663728 U 1/2013

OTHER PUBLICATIONS

Amphenol Corporation, "Paladin Daughtercard Connector Press-Fit Installation Process", Amphenol TCS, a division of Amphenol Corp., 2017; 26 pages.
(Continued)

*Primary Examiner* — Donghai D Nguyen
(74) *Attorney, Agent, or Firm* — Cantor Colburn LLP; Tihon Poltavets

(57) ABSTRACT

Aspects of the invention include a stutter step press-fit connector insertion process. A non-limiting example of a method includes applying a force to at least one press-fit pin for causing the press-fit pin to move in a direction of a through-hole of a printed circuit board, wherein a value of the force increases as the press-fit pin moves in the direction of the through-hole. In response to detecting contact between the press-fit pin and a surface profile of the through-hole, a first pause of the force is introduced for a pre-determined time interval, wherein the value of the force remains generally static during the pre-determined time interval. The force is reapplied to the press-fit pin upon completion of the time interval, wherein the value of the force increases during the reapplying until the press-fit pin is inserted into the through-hole.

7 Claims, 6 Drawing Sheets

(58) Field of Classification Search
USPC ..... 29/832, 837, 842, 844, 845
See application file for complete search history.

(56) References Cited

U.S. PATENT DOCUMENTS

| | | | | |
|---|---|---|---|---|
| 6,098,275 | A | 8/2000 | Wuyts et al. | |
| 6,231,353 | B1 | 5/2001 | Rathburn | |
| 6,655,019 | B2 * | 12/2003 | Wuyts ..... | H05K 13/0447 29/739 |
| 8,447,960 | B2 | 5/2013 | Chen et al. | |
| 9,287,640 | B2 | 3/2016 | Hirschy | |
| 9,983,230 | B2 | 5/2018 | Choi et al. | |
| 2009/0241325 | A1 | 10/2009 | Mukai | |

OTHER PUBLICATIONS

Becerra J. et al., "Press Fit Technology Roadmap and Control Parameters for a High Performance Process", published in IPC APEX EXPO Conference Proceedings; from Flextronics; 17 pages.
Parenti et al., "Validating Press-Fit Connector Installation", Circuits Assembly, 2003; pp. 26-29.

* cited by examiner

300

400

STUTTER STEP PRESS-FIT CONNECTOR INSERTION PROCESS

BACKGROUND

The present invention generally relates to press-pin insertion, and more specifically, to a stutter step press-fit connector insertion process.

Press-fit technology is the insertion of flexible or rigid press-fit pins, which are pins that permit connection into through-holes without soldering. The basic requirement is that the diameter of a press-fit zone of the pin must be greater than the diameter of the through-hole. During the press-fit process, there is deformation of the pin. Thus, the pin slides into the through-hole and is connected with the through-hole tightly.

SUMMARY

Embodiments of the present invention are directed to a stutter step press-fit connector insertion process. A non-limiting example of a method includes applying a force to at least one press-fit pin for causing the at least one press-fit pin to move in a direction of a through-hole of a printed circuit board, wherein a value of the force increases as the at least one press-fit pin moves in the direction of the through-hole. In response to detection of contact between the at least one press-fit pin and a surface profile of the through-hole, a first pause of the force is introduced for a pre-determined time interval, wherein the value of the force remains generally static during the pre-determined time interval. The force is reapplied to the at least one press-fit pin upon completion of the time interval, wherein the value of the force increases during the reapplying until the at least one press-fit pin is inserted into the through-hole.

Other embodiments of the present invention implement features of the above-described in electromechanical systems and computer program products.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

The diagrams depicted herein are illustrative. There can be many variations to the diagrams or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

DETAILED DESCRIPTION

One or more embodiments of the present invention provide a press-pin insertion method and apparatus that introduces one or more pauses during insertion of a pin into a printed circuit board (PCB) to reduce instances of pin buckling or bending.

As computing system production progresses, designers are using more press-fit connections, and the press-fit pins are becoming smaller. The increased use of press-fit pins and the decrease in the size of the press-fit pins increases the likelihood that one or more press-fit pins buckle or bend during insertion. If a pin buckles, not only does the PCB lose an electrical connection, the intended connection is structurally less secure as well. Buckling or bending refers to the deformation of a press-fit pin in a lateral direction. Buckling or bending can be due to a number of reasons, including but not limited to, the diameter of through-holes in a PCB being too small, the connector housing does not support the pins during the insertion process, and the insertion of plated pins are causing high frictional forces when inserted into a plated through-hole.

In response to this issue, designers typically either apply lubrication and/or redesign the PCB. The issue with lubrication is that the lubricants hold impurities, and this leads to contamination of the PCB. The issue with redesigning a PCB is that it is time-consuming and not amenable to a project production schedule.

One or more embodiments of the present invention address one or more of the above-described shortcomings of the prior art by providing a press-pin insertion apparatus and method, in which one or more pauses are introduced during the insertion process. The pauses grant the press-fit pin time to decompress and thereby reduce the instances of pin buckling or bending.

Figure 1:
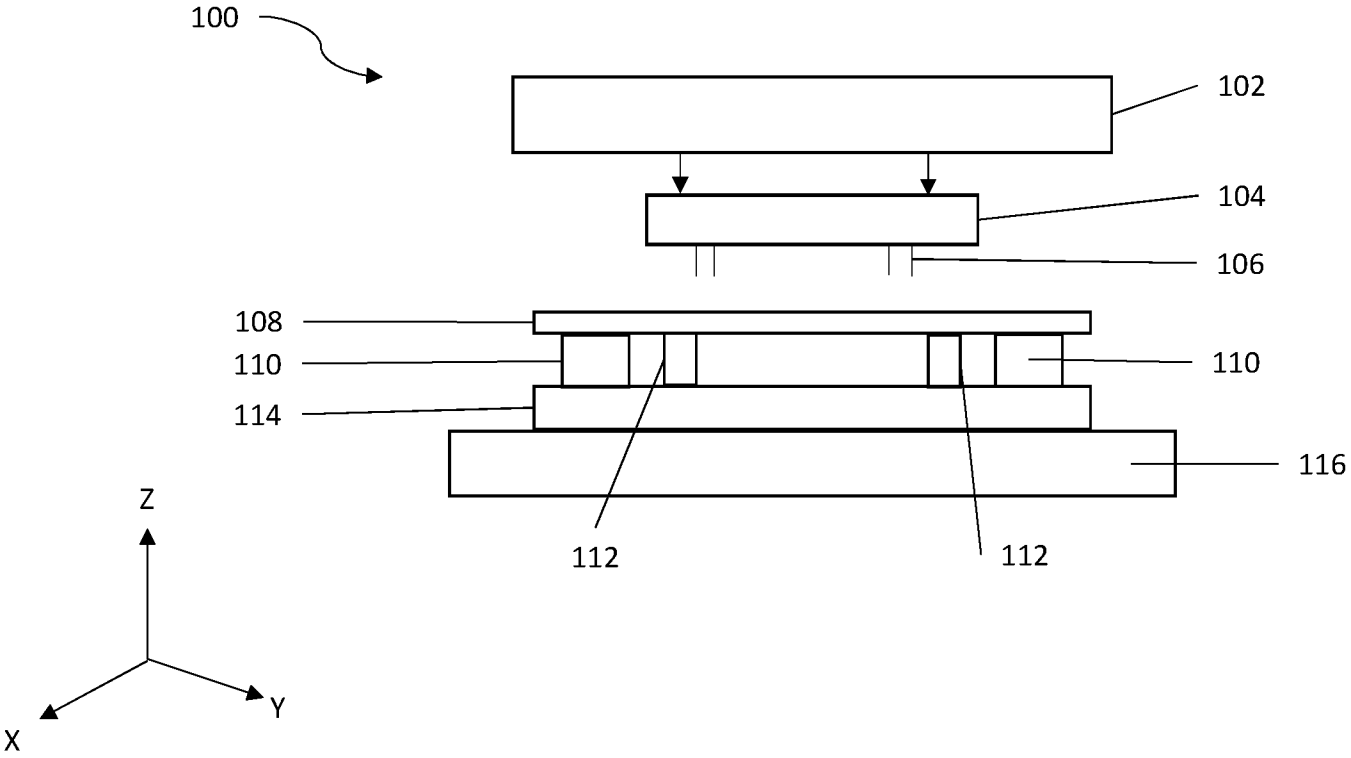
FIG. 1 illustrates a block diagram of components of a press-pin insertion apparatus in accordance with one or more embodiments of the present invention.

Turning now to FIG. 1, an exploded view of a press-pin insertion apparatus 100 is generally shown in accordance with one or more embodiments of the present invention. The press-pin insertion apparatus 100 includes a ram assembly 102 for causing an insertion force against a press-fit pin module 104. The velocity of the ram assembly 102 is managed manually or by a controller (not shown). The ram assembly 102 includes an actuator (not shown) and a head (not shown) connected to the actuator. The ram assembly 102 can be operated manually or by a computer-based controller. The press-fit pin module 104 holds an array of press-fit pins 106 arranged to mirror through-holes 202 of a PCB 108. Each press-fit pin 106 is connected to a connector housing 200 that receives a force from the ram assembly 102. The PCB 108 is mounted on a support plate 114 via one or more positioning pins 112. The positioning pins 112 are arranged in a manner to be inserted into respective receivers (not shown) of the PCB 108. The positioning pins 112 secure the PCB 108 into position such that the press-fit pins 106 align with the through-holes 202 of the PCB 108. One or more support blocks 110 are fastened to the support plate 114 to provide additional support for the PCB 108 against the force applied by the ram assembly 102. The support plate 114 rests on a base plate 116 to secure the apparatus. The base plate 116 is a rigid and stationary structure for providing additional support.

In operation, the ram assembly 102 moves in the z-direction towards the PCB 108 and applies a force to the connector housing 200. The connector housing 200 is connected to the press-fit pins 106, which are aligned with the through-holes 202 on the PCB 108. The ram assembly 102 causes the connector housing 200 to compress against the PCB 108. The pins 106 are inserted into the through-holes 202 due to the force caused by the ram assembly 102.

Figure 2:
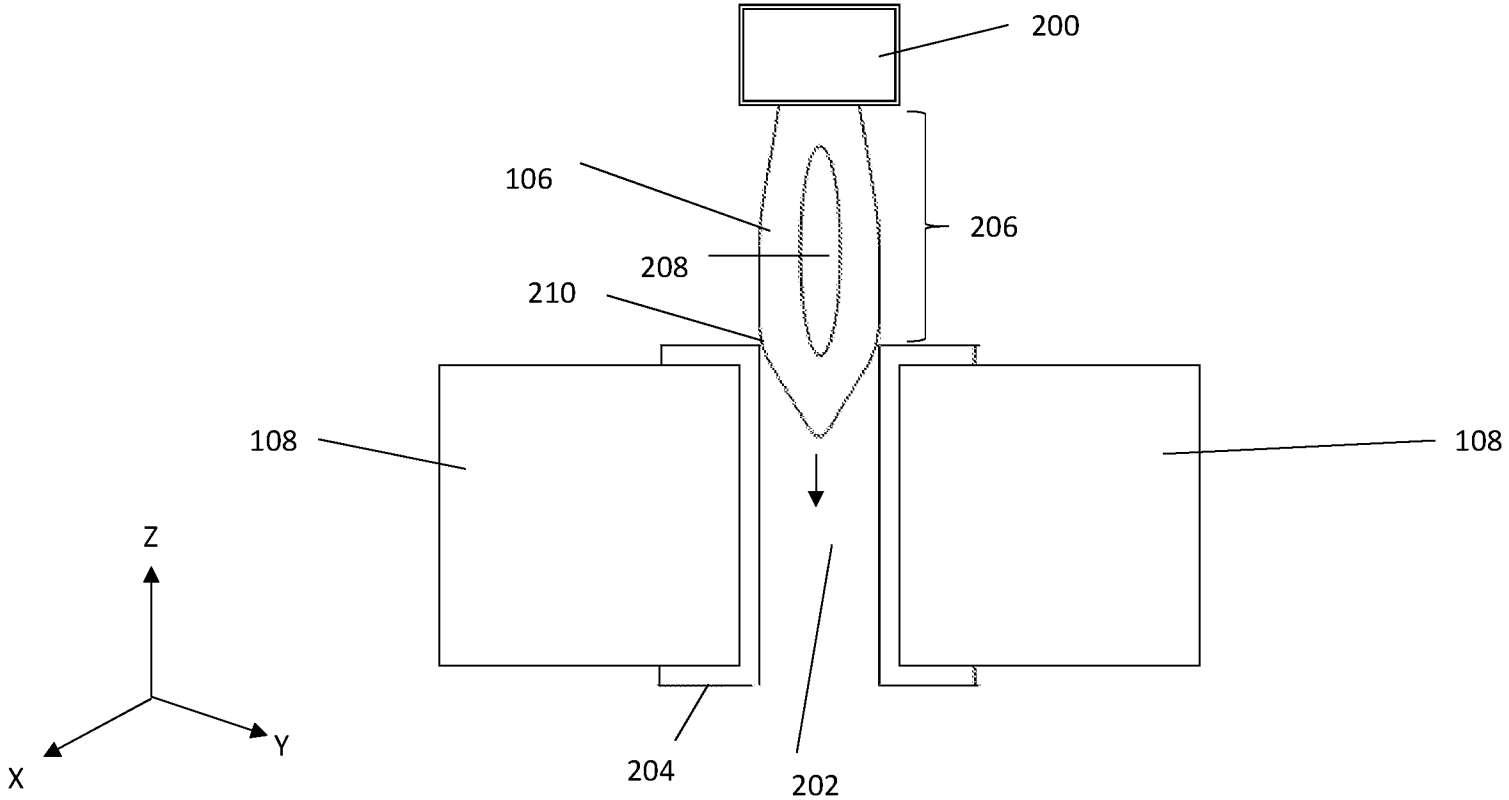
FIG. 2 illustrates an insertion of a press-pin in accordance with one or more embodiments of the present invention.

Referring to FIG. 2, a press-fit pin 106 connected to the connector housing 200 is shown being inserted into a through-hole 202 of the PCB 108. The through-hole 202 is an orifice that extends through the PCB 108. In some embodiments, the through-hole 202 includes a plating 204 made from a conductive material for enabling an electrical connection between the PCB 108 and a mounted device (not shown). The press-fit pin 106 includes a press-fit zone 206 made from a compliant material. Furthermore, a diameter of the press-fit zone 206 is greater than a diameter of the through-hole 202, including the plating 204. In the instance that the through-hole 202 does not include plating 204, the diameter of the press-fit zone 206 is greater than the through-hole 202. In some instances, the press-fit zone 206 further includes a hollow compartment 208. During the insertion process, the press-fit pin 106 makes contact with the PCB 108 or the plating 204 at one or more contact points 210 on the press-fit pin 106. In response to making contact at the contact point 210, the press-fit pin 106 begins to deform due to the force applied by the ram assembly 102. The press-fit zone 206 absorbs the deformations causing the press-fit pin 106 to be inserted and secured tightly into the through-hole 202.

In a conventional press-pin insertion apparatus 100, the ram assembly 102 applies a continuous force to the connector housing 200 without any reduction in force throughout the insertion process. Therefore, as a press-fit pin 106 makes contact with the through-hole 202 or the plating 204 it may begin to buckle. However, a conventional ram assembly 102 continues to apply a force, regardless of buckling or bending. This results in either the press-fit pin 106 deforming, breaking, or otherwise not being inserted into the through-hole 202 properly.

Figure 3:
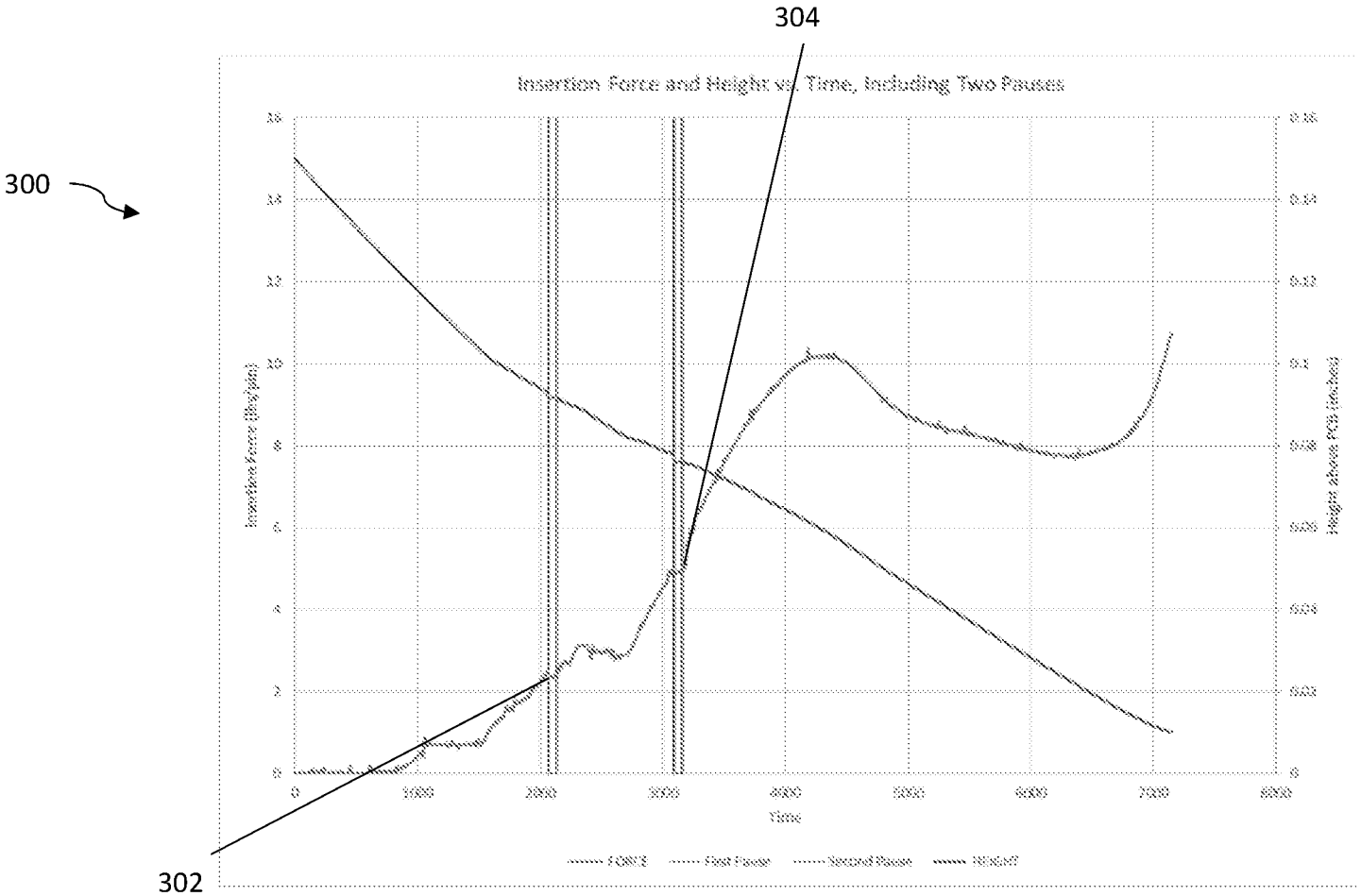
FIG. 3 is a plot of insertion force and height vs. time in accordance with one or more embodiments of the present invention.
Figure 4:
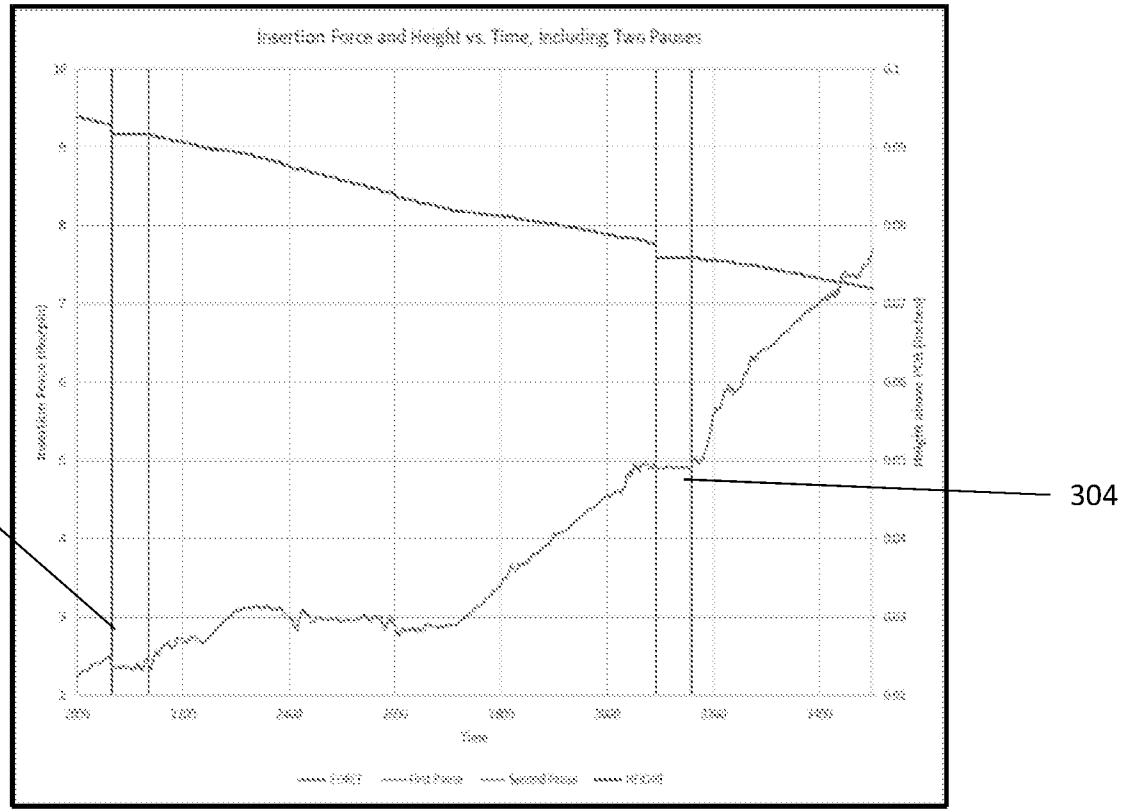
FIG. 4 is a plot of insertion force and height vs. time in accordance with one or more embodiments of the present invention.

Embodiments of the present invention provide a press-pin insertion apparatus 100, in which the ram assembly 102 introduces one or more pauses during the insertion process to reduce the instances of pin buckling or bending. Referring to FIGS. 3 and 4, respective plots 300, 400 are shown of a relationship between an insertion force, a height of a bottom portion of a pin above a PCB, and time. FIG. 4 is blown-up plot 400 of the pauses 302, 304 illustrated in FIG. 3. The insertion force shown on the right-hand y-axis, the height above the PCB is shown on the left-hand y-axis, and time is shown on the x-axis. As illustrated in FIG. 4, the press-pin insertion apparatus 100 introduces two pauses 302, 304, which are time intervals of a generally static amount of force, during the insertion process. As seen during these pauses 302, 304, the height above the PCB and the amount force from the ram assembly 102 remains generally static. Even though the ram assembly 102 is still applying a force to the connector housing 200, the force is not significant enough to cause the press-fit pin 106 to continue inserting, and therefore no buckling or bending. In the instance that a press-fit pin 106 is buckling or bending under the pressure of the ram assembly 102, the pauses remove the increasing force causing the press-fit pin 106 to buckle, which permits the press-fit pin 106 to decompress and properly insert through the through-hole 202. In some embodiments, rather than pause in a stationary position, the ram assembly 102 moves in a z-direction opposite of the PCB 108, thereby causes in the press-fit pin to move in the opposite direction. This allows the press-fit pin 106 to further decompress. It should be appreciated that although the plots 300, 400 show two pauses, any number of pauses can be introduced to reduce instances of buckling or bending.

The amount of force applied by the ram assembly 102 to the connector housing 200 to cause the press-fit pin 106 to buckle or bend is related to Euler's critical load formula, which states:

$$P_{cr} = \frac{\pi^2 * E * I}{(k * L)^2}$$

where $P_{cr}$ is the critical buckling load, E is Young's modulus, I=beam (press-fit pin 106) moment of inertia, k is the beam constrain factor, and L is the beam length. Young's modulus I measures the stiffness of a material and is therefore dependent upon the material of the press-fit pin 106. The critical buckling load $P_{cr}$ is the maximum force from the ram assembly 102 that the press-fit pin 106 can accept prior to buckling. In the instance that the press-fit pin 106 is properly inserting into the through-hole 202, the $P_{cr}$ is not reached. However, an improperly aligned press-fit pin 106, an improperly manufactured press-fit pin 106, an orifice having improper dimensions, and/or frictional forces will cause the load to reach the critical buckling load $P_{cr}$ and thereby causing the press-fit pin 106 to buckle or bend.

Figure 5:
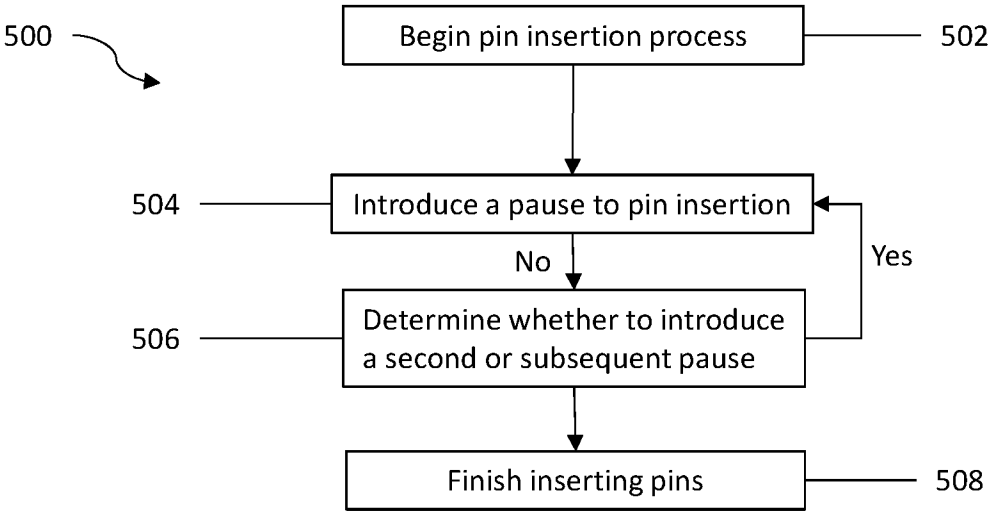
FIG. 5 is a flow diagram of a process for pin insertion in accordance with one or more embodiments of the present invention.

Referring to FIG. 5, a flow diagram of a process for pin insertion in accordance with one or more embodiments of the present invention is shown. As block 502, the pin insertion process begins and a force is applied to cause a press-fit pin to be inserted into a through-hole. After the press-fit pin has made contact with a surface profile of a through-hole or plating, a pause is introduced, in which the force applied does not increase at block 504. The detection of contact between the press-fit pin and the through-hole can be based on an estimated time between the beginning of the insertion process and contact, a height of the press-fit pin in relation to the through-hole, or a pressure sensor that senses a reaction force from the press-fit pin. A timing and a time length of a pause is based on a number of factors including, but not limited to, size of the press-fit pin, a number of press-fit pins, a PCB cross-sectional thickness. Additionally, the pause can be introduced manually or automatically by a controller. At block 506, a determination is made on whether to introduce a second or subsequent pause. If a determination that a second or subsequent pause should be introduced, the process introduces the second or subsequent pause at block 504. If a determination is made that no second or subsequent pause should be introduced, the process finishes inserting the pin at block 508.

Figure 6:
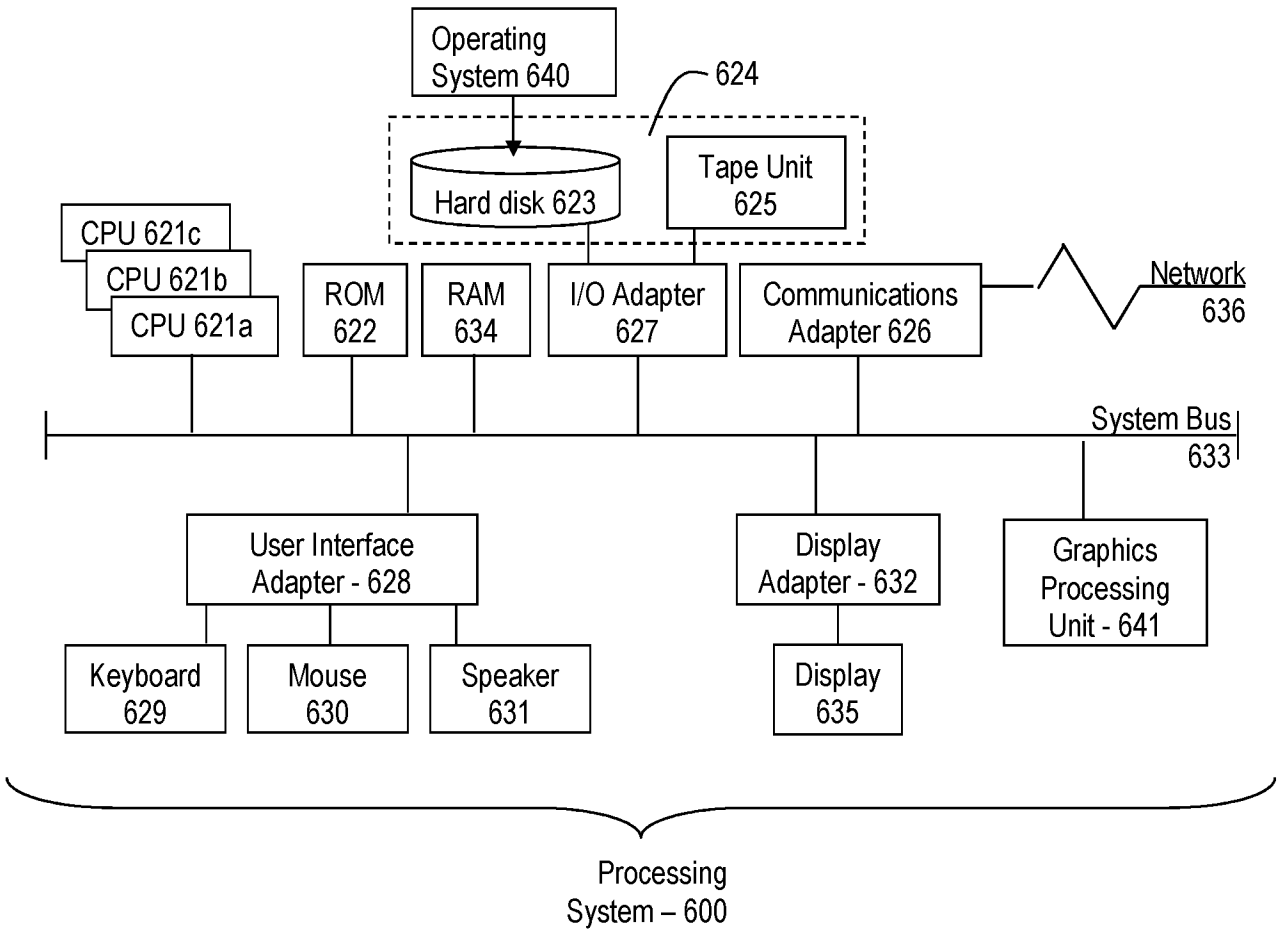
FIG. 6 illustrates a block diagram of components of a processing system in accordance with one or more embodiments of the present invention.

Referring to FIG. 6, there is shown an embodiment of a processing system 600 for implementing the teachings herein. In this embodiment, the system 600 has one or more central processing units (processors) 621*a*, 621*b*, 621*c*, etc. (collectively or generically referred to as processor(s) 621). In one or more embodiments, each processor 621 may include a reduced instruction set computer (RISC) microprocessor. Processors 621 are coupled to system memory 634 and various other components via a system bus 633. Read only memory (ROM) 622 is coupled to the system bus 633 and may include a basic input/output system (BIOS), which controls certain basic functions of system 600.

FIG. 6 further depicts an input/output (I/O) adapter 627 and a network adapter 626 coupled to the system bus 633. I/O adapter 627 may be a small computer system interface (SCSI) adapter that communicates with a hard disk 623 and/or tape storage drive 625 or any other similar component. I/O adapter 627, hard disk 623, and tape storage device 625 are collectively referred to herein as mass storage 624. Operating system 640 for execution on the processing system 600 may be stored in mass storage 624. A network adapter 626 interconnects bus 633 with an outside network 636 enabling data processing system 600 to communicate with other such systems. A screen (e.g., a display monitor) 635 is connected to system bus 633 by display adaptor 632, which may include a graphics adapter to improve the performance of graphics intensive applications and a video controller. In one embodiment, adapters 627, 626, and 632 may be connected to one or more I/O busses that are connected to system bus 633 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 633 via user interface adapter 628 and display adapter 632. A keyboard 629, mouse 630, and speaker 631 all interconnected to bus 633 via user interface adapter 628, which may include, for example, a Super I/O chip integrating multiple device adapters into a single integrated circuit.

In exemplary embodiments, the processing system 600 includes a graphics processing unit 641. Graphics processing unit 641 is a specialized electronic circuit designed to manipulate and alter memory to accelerate the creation of images in a frame buffer intended for output to a display. In general, graphics processing unit 641 is very efficient at manipulating computer graphics and image processing and has a highly parallel structure that makes it more effective than general-purpose CPUs for algorithms where processing of large blocks of data is done in parallel.

Thus, as configured in FIG. 6, the system 600 includes processing capability in the form of processors 621, storage capability including system memory 634 and mass storage 624, input means such as keyboard 629 and mouse 630, and output capability including speaker 631 and display 635. In one embodiment, a portion of system memory 634 and mass storage 624 collectively store an operating system coordinate the functions of the various components shown in FIG. 6.

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

One or more of the methods described herein can be implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

In some embodiments, various functions or acts can take place at a given location and/or in connection with the operation of one or more apparatuses or systems. In some embodiments, a portion of a given function or act can be performed at a first device or location, and the remainder of the function or act can be performed at one or more additional devices or locations.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The present disclosure has been presented for purposes of illustration and description, but is not intended to be exhaustive or limited to the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

The diagrams depicted herein are illustrative. There can be many variations to the diagram or the steps (or operations) described therein without departing from the spirit of the disclosure. For instance, the actions can be performed in a differing order or actions can be added, deleted or modified. Also, the term "coupled" describes having a signal path between two elements and does not imply a direct connection between the elements with no intervening elements/ connections therebetween. All of these variations are considered a part of the present disclosure.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instruction by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A method comprising:

applying a force to at least one press-fit pin for causing the at least one press-fit pin to move in a direction of a through-hole of a printed circuit board, wherein the force increases as the at least one press-fit pin moves in the direction of the through-hole;

introducing, in response to detection of contact between the at least one press-fit pin and a surface profile of the through-hole, a first pause of the force for a pre-determined time interval, wherein the force remains generally static during the pre-determined time interval;

introducing a second pause to the force, wherein the force remains generally static during the second pause; and reapplying the force to the at least one press-fit pin, wherein the force increases during the reapplying until the at least one press-fit pin is inserted into the through-hole.

2. The method of claim 1, wherein the force is applied to the at least one press-fit pin via a connecter housing attached to the at least one press-fit pin.

3. The method of claim 1, wherein the first pause is introduced manually.

4. The method of claim 1, wherein the first pause is introduced automatically by a computer-based controller.

5. The method of claim 1, wherein detecting contact between the at least one press-fit pin and the surface profile of the through-hole is based on at least one of an estimated time between the beginning of application of the force and contact, a height of the at least one press-fit pin in relation to the through-hole, and a pressure sensor sensing a reaction force from the press-fit pin.

6. The method of claim 1, wherein a timing and length of the pre-determined time interval are determined based on at least one of a size of the at least one press-fit pin, a number of press-fit pins, and a printed circuit board cross-sectional thickness.

7. The method of claim 1 further comprising:

moving the at least one press-fit pin in an opposite direction of the printed circuit board during the first pause.

* * * * *